US006364791B1

(12) United States Patent
Janes

(10) Patent No.: US 6,364,791 B1
(45) Date of Patent: Apr. 2, 2002

(54) DOUBLE LOOP STRING VIBRATION DAMPER FOR SPORTS RACQUETS

(75) Inventor: Richard Janes, Burlington Township, NJ (US)

(73) Assignee: Benetton Sportsystem USA, Inc., Bordentown, NJ (US)

( * ) Notice: Subject to any disclaimer, the term of this patent is extended or adjusted under 35 U.S.C. 154(b) by 0 days.

(21) Appl. No.: 09/412,098

(22) Filed: Oct. 4, 1999

(51) Int. Cl.[7] ..... A63B 49/00
(52) U.S. Cl. ..... 473/522; 473/553
(58) Field of Search ..... 473/520, 521, 473/522, 524, 553, 543, 537, FOR 171, FOR 178

(56) References Cited

U.S. PATENT DOCUMENTS

| | | | | | |
|---|---|---|---|---|---|
| 4,911,445 | A | * | 3/1990 | Ferrari et al. | 473/522 |
| 4,962,928 | A | * | 10/1990 | Camara et al. | 473/522 |
| 5,096,194 | A | * | 3/1992 | Yong et al. | 473/522 |
| 5,149,090 | A | * | 9/1992 | Chen et al. | 473/522 |
| 5,169,146 | A | * | 12/1992 | Soong | 473/522 |
| 5,211,397 | A | * | 5/1993 | Davis et al. | 473/522 |

FOREIGN PATENT DOCUMENTS

| | | | | |
|---|---|---|---|---|
| DE | 3123690 | * | 3/1983 | 473/FOR 171 |
| GB | 2223953 | * | 4/1990 | 473/FOR 178 |

* cited by examiner

*Primary Examiner*—Raleigh W. Chiu
(74) *Attorney, Agent, or Firm*—Skadden, Arps, Slate, Meagher & Flom LLP

(57) ABSTRACT

A string vibration damper, for use on a sports racquet having an interwoven string bed, is made of a soft, elastomeric material and comprises a pair of end members connected by a connecting portion. Each end member has a hole therethrough with a hole diameter preferably in the range of 4 mm and 6 mm, and a maximal cross-sectional height "h" preferably in the range of 2 mm and 4 mm. The connecting portion preferably has a length of at least 50 mm, and most preferably at least 100 mm, so as to contact numerous strings. End member is secured to the string bed by being inserted between a pair of crossing strings. The end member is positioned so that the point of intersection of the crossing strings lies within the hole such that the crossing strings to remain touching. Because the strings are under tension, the string portions on either side of the hole contort the end member so that the end member are firmly secured in place on the stringbed.

19 Claims, 10 Drawing Sheets

DOUBLE LOOP STRING VIBRATION DAMPER FOR SPORTS RACQUETS

BACKGROUND OF THE INVENTION

The present invention relates to sports racquets such as tennis racquets, squash racquets, badminton racquets, and racquetball racquets, which include a head portion having an interwoven string bed for hitting the ball.

When a ball impacts the string bed of a sports racquet, the strings elongate such that the string bed deflects. As the ball rebounds off the string bed, most of the energy stored in the string bed is returned to the ball, however the strings continue to vibrate after the ball has left the string bed. Such vibration occurs at a relatively high frequency and is annoying to players.

In order to reduce such string vibration, there have been two approaches. Commonly owned U.S. patent application Ser. No. 08/935,881 discloses a sports racquet with a grommet strip in which the grommet pegs include flat surfaces against which the vibrating strings rub. Such grommet pegs are effective in reducing string vibration without interfering with the ability of the string bed to deflect upon ball impact. The other approach has been to utilize string vibration dampers which can be mounted on the string bed.

Most string vibration dampers are made of a soft, elastomeric material and are either in the form of an elongated strip which weaves between a number of consecutive strings, or in the form of a plug-type device which fits between a pair of adjacent strings. An example of the former type of damper is the Prince Zero Vibe damper, which is disclosed on commonly owned U.S. Pat. No. 5,211,397. In this device, a thin, flat web connects a pair of doughnut-shaped ends, which include opposed grooves, oriented at 90° relative to the longitudinal axis of the web, for receiving a pair of adjacent strings. In this manner, each doughnut-shaped end fits between a pair of adjacent strings, with the strings being received in the grooves, and the connecting web weaves into the string bed. An example of the latter type of damper is the Prince Vibra Cap damper, which is an elongated caplet-shaped damper also having opposed, outwardly facing grooves for receiving a pair of adjacent strings.

Such vibration dampers are effective as a means of greatly reducing the vibrations of strings in racquets. However, in the case of these dampers and other known dampers, there is a tendency for the dampers to work themselves loose from the strings during play due to the impact force of the ball. When this occurs, it can be distracting and disrupt the point.

In order to secure the damper better on the string bed, it would be possible to provide holes through the damper, and to direct the strings through such holes such that the damper cannot fall off. However, it would not be possible to mount such a damper after the racquet is strung, or to remove it without also removing the racquet strings. Thus, such a damper would not be a practical replacement for existing string bed dampers which the player can mount or remove at will.

BRIEF SUMMARY OF THE INVENTION

The present invention is a string vibration damper which provides effective damping of a string bed, but at the same time is much more securely mounted on the string bed than known designs.

More particularly, a string vibration damper, for use on a sports racquet having an interwoven string bed, is made of a soft, elastomeric material and comprises a pair of end members connected by a connecting portion. Each end member has a hole therethrough with a hole diameter preferably in the range of 4 mm and 6 mm, and a maximal cross-sectional height "h" preferably in the range of 2 mm and 4 mm. The connecting portion preferably has a length of at least 50 mm, and most preferably at least 100 mm, so as to contact numerous strings. End member is secured to the string bed by being inserted between a pair of crossing strings. The end member is positioned so that the point of intersection of the crossing strings lies within the hole such that the crossing strings remain touching. Because the strings are under tension, the string portions on either side of the hole contort the end member so that the end member are firmly secured in place on the string bed.

For a better understanding of the invention, reference is made to the following detailed description of a preferred embodiment, taken in conjunction with the drawings accompanying the application.

DETAILED DESCRIPTION OF THE INVENTION

Figure 1:
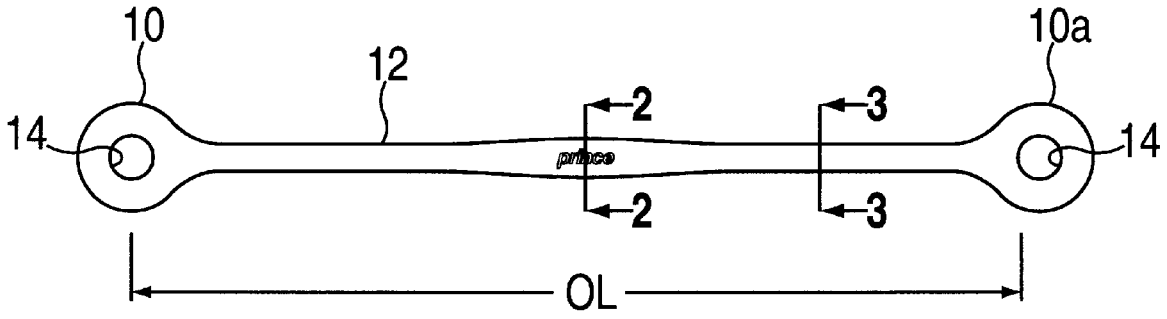
FIG. 1 is a plan view of a string vibration damper according to the invention.
Figure 2:
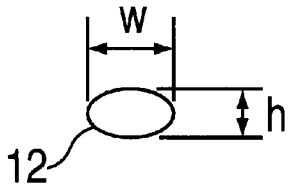
FIGS. 2 and 3 are cross-sectional views, taken through lines 2—2 and 3—3, respectively.
Figure 3:
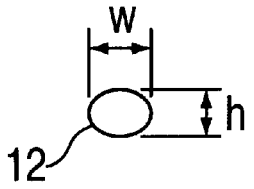

A first example of a string vibration damper according to the invention is shown in FIGS. 1–7. The damper includes a pair of end members 10, 10*a* connected by a connecting portion 12. The connecting portion 12 is in the form of a thin, flat web. As shown in FIGS. 1–3, the width "w" of the connecting portion 12 increases in the middle, and decreases in the regions adjacent the end members 10, 10*a*. As an example, the width "w" in the middle of the connecting portion 12 is 5.5 mm (FIG. 2), whereas the width "w" to either side of the center portion is 4 mm (FIG. 3). The height "h" of the connecting portion 12 and end members 10, 10*a* is preferably constant.

Each end member 10, 10*a* has a hole 14 therethrough with a hole diameter in the range of 3 mm and 10 mm, more preferably in the range of 4 mm and 6 mm, and a maximal cross-sectional height "h" preferably in the range of 1 mm and 6 mm, more preferably between 2 mm and 4 mm. In the example, the end members have a maximal height "h" of 3 mm and a width "w" of 4 mm, and have a cross-section identical to the cross section shown in FIG. 3.

The connecting portion 12 preferably has a length of at least 50 mm, and most preferably at least 100 mm, so as to contact numerous strings. In the example, the damper has an overall length "OL", i.e., distance between holes 14, of 110 mm. The damper is made of a soft, thermoplastic elastomeric material, e.g., silicone rubber, having about 50 shore A durometer, but other materials and durometers may be employed. Preferably, the damper is formed using a compression molding process.

Figure 4:
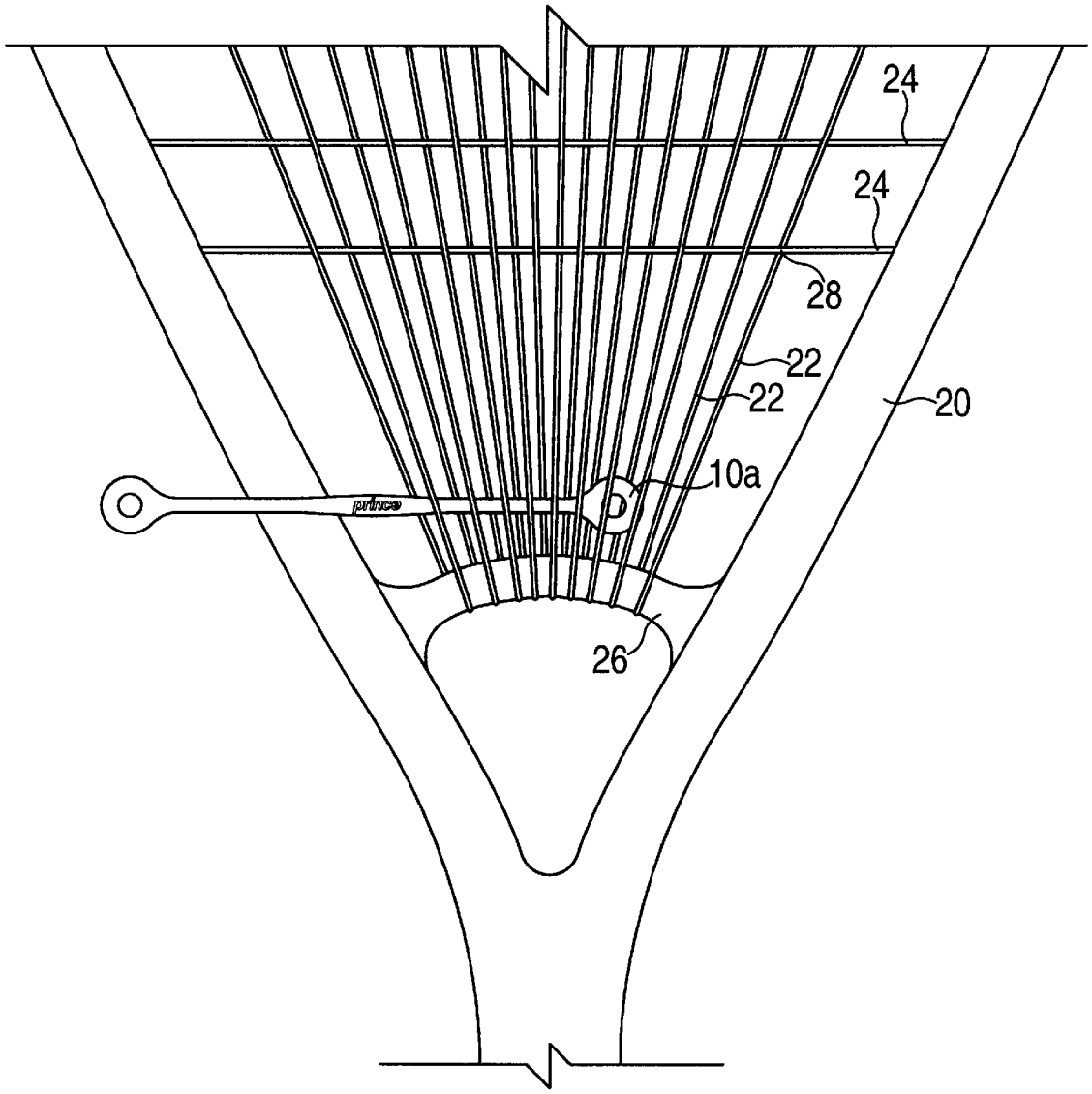
FIG. 4 is a plan view of the lower portion of the head of a tennis racquet, demonstrating how the damper may be inserted into a racquet string bed.

FIG. 4 shows a portion of a tennis racquet 20 having a plurality of main strings 22, which extend generally parallel to the racquet axis, and a plurality of cross strings 24, which extend normal to the racquet axis and are interwoven with the main strings 22. The racquet shown in FIG. 4 includes, instead of a conventional throat bridge, a power ring 26, as disclosed in commonly owned U.S. Pat. No. 5,562,283. As shown, in such a racquet the lower ends of the main strings 22 wrap around the power ring 26 and extend upwardly from the opposite side. The racquet 20 shown in FIG. 4 is merely illustrative, and the damper of the present invention may be used with any type of sports racquet having an interwoven string bed.

Figure 5:
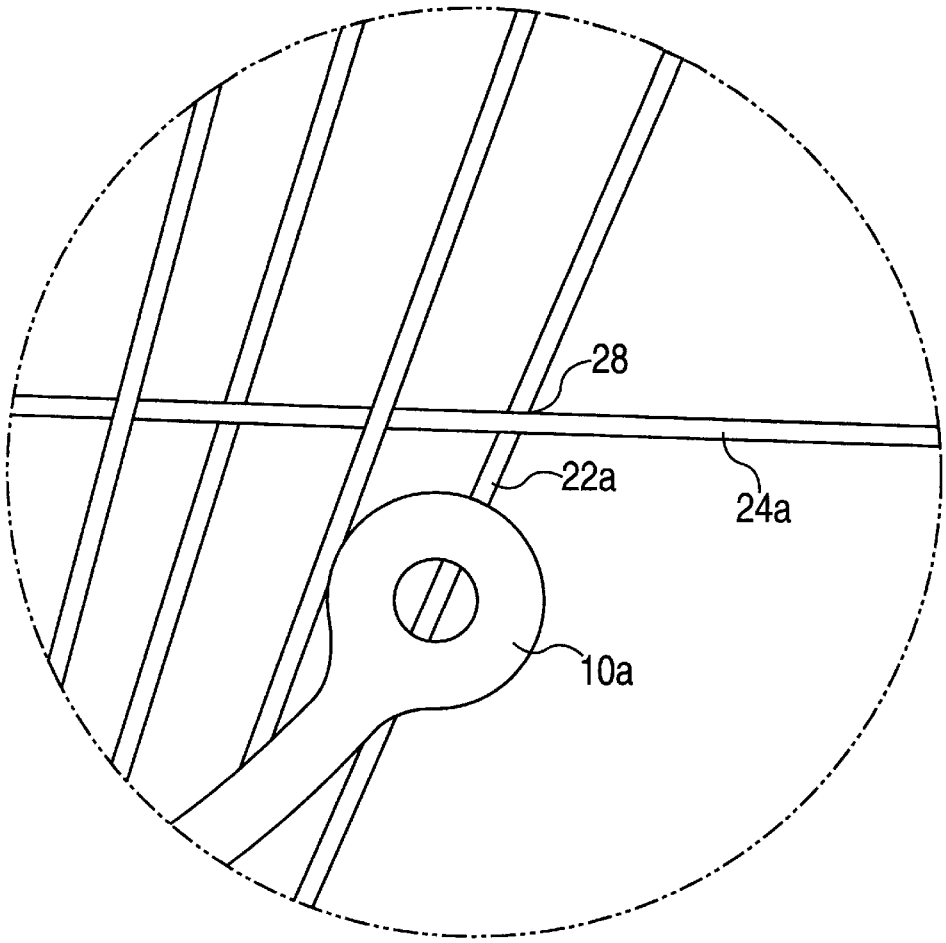
FIG. 5 is an enlarged view of a lower portion of the racquet string bed, showing one end of the damper being positioned to be secured to the strings.
Figure 6:
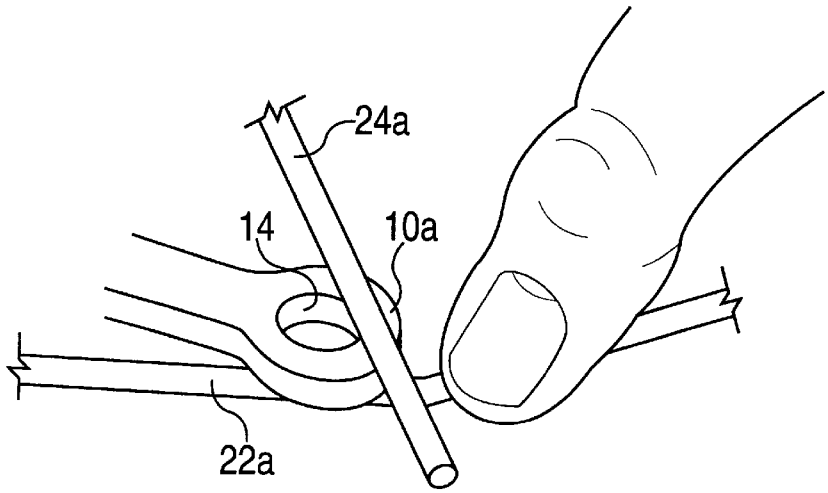
FIG. 6 is an enlarged view of a portion of the racquet string bed, showing one end of the damper being inserted between two crossing strings in order to be secured to the strings.

An example of the installation of the damper will now be given. As shown in FIG. 4, due to the power ring 26, alternate main strings 22 are separated from one another in the vicinity of the power ring 26. One end member 10*a* of the damper is inserted in the space between the forward and rearwardly lying main strings 22, and moved upwardly to a position just below a selected intersection point 28 between a crossing main and cross string, 22*a*, 24*a*, respectively, as shown in FIG. 5. As shown in FIG. 6, one of the strings is pushed away from the other string, e.g.,, e.g., main string 22*a* is pushed downwardly, away from cross-string 24*a*, so that the end member 10*a* can be inserted between the two strings 22*a*, 24*a*.

Figure 7:
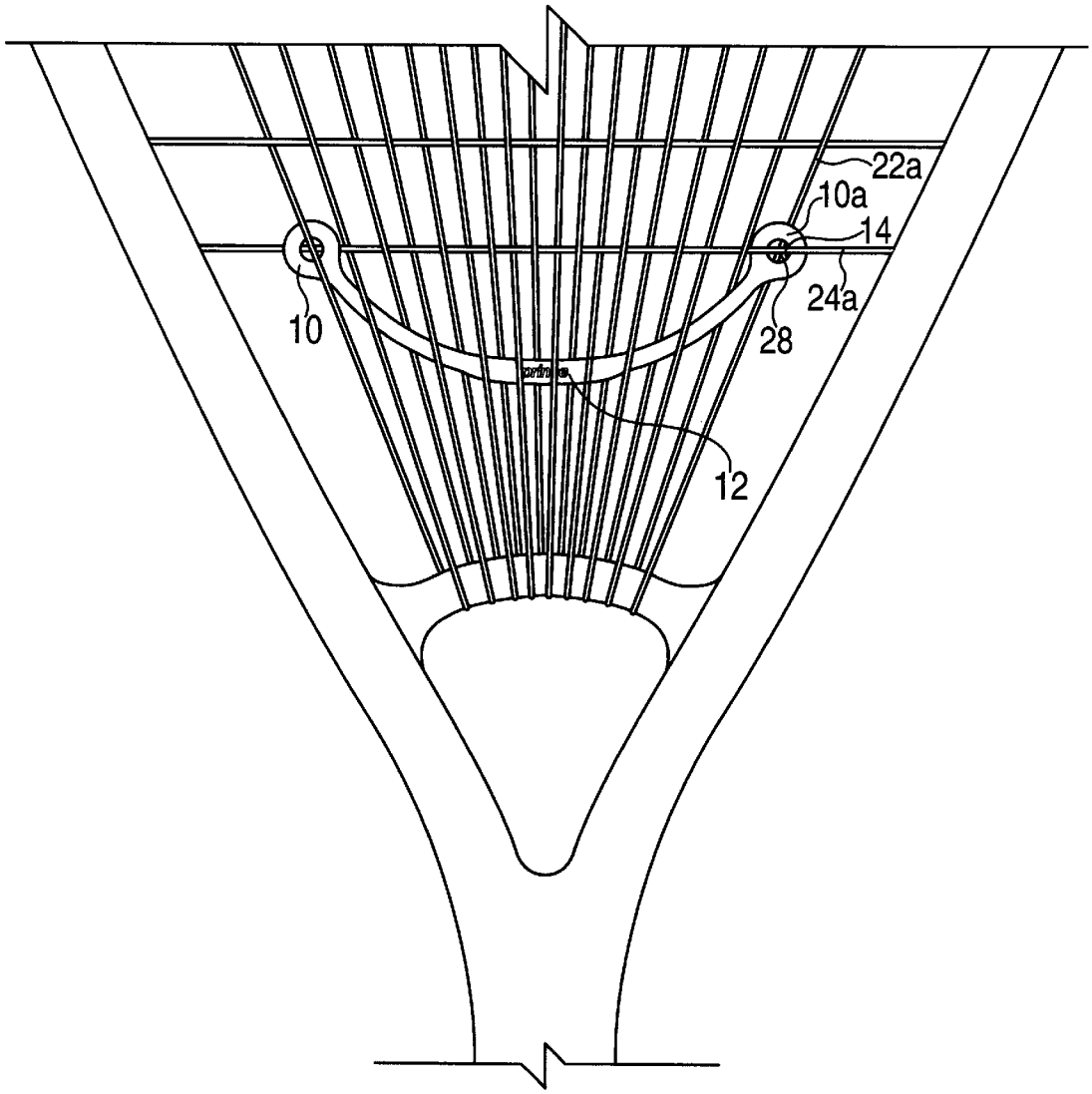
FIG. 7 shows the damper after both ends have been secured to the strings.

As shown in FIG. 7, after the leading edge of the end member 10*a* has passed between the two intersecting strings 22*a*, 24*a*, the end member 10*a* is positioned so that the intersection point 28 of the two strings lies in the hole 14. In this manner, the strings 22*a*, 24*a* contact one another as if the end member 10*a* were not present. The process is then repeated for the opposite end member 10. Because the damper is made of a soft, elastomeric material, the connecting portion 12 bends easily, as shown in FIG. 7, into an arc shape.

Each end member 10, 10*a* is secured to the string bed between a pair of crossing strings. Because the strings are under tension, the string portions on either side of the hole 14 contort the end members 10, 10*a* so that the end members 10, 10*a* are firmly secured in place on the string bed.

Figure 8:
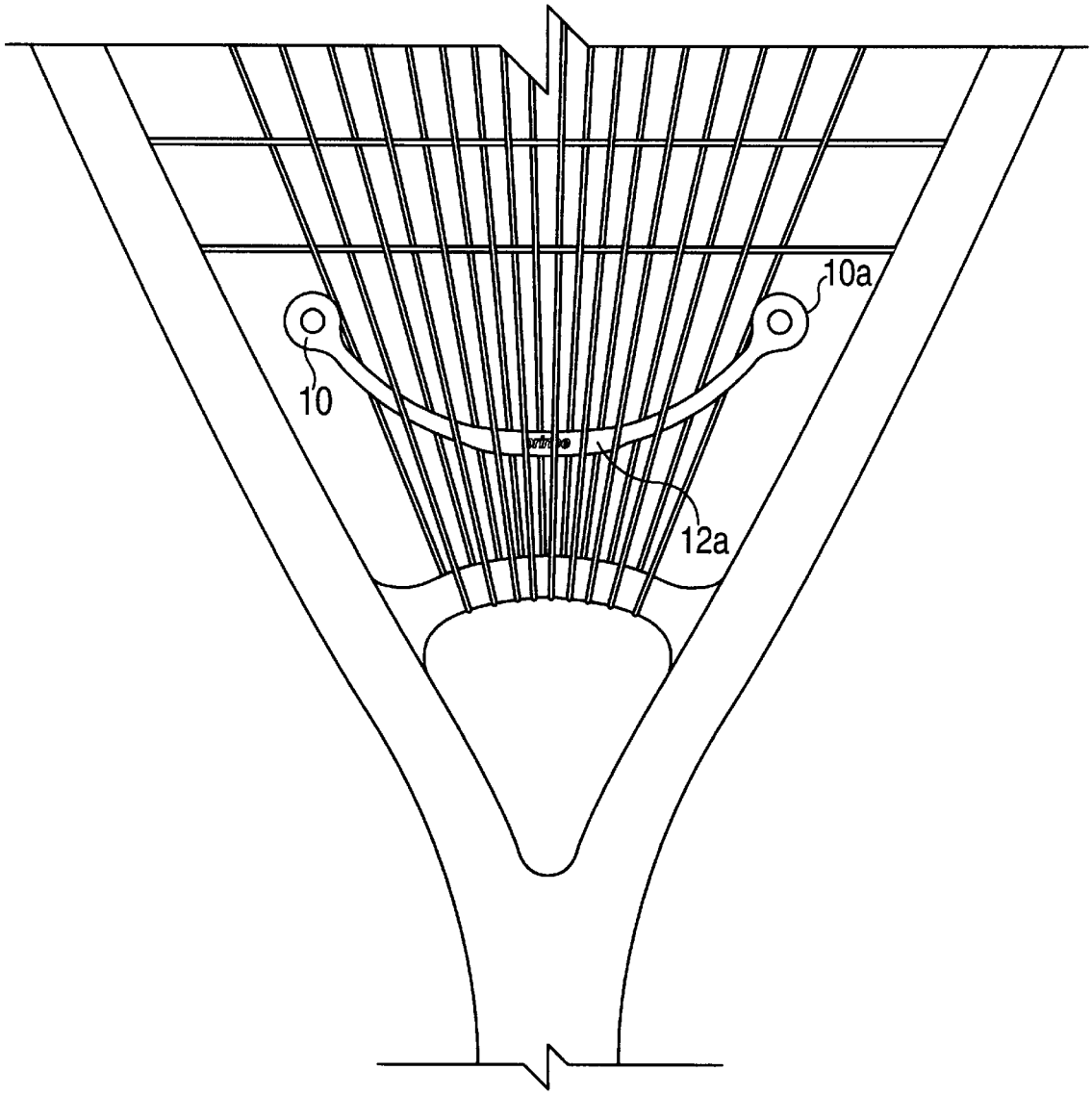
FIG. 8 shows an alternate embodiment of a damper, as it is being inserted into the string bed.

FIG. 8 shows an alternative embodiment of a damper which is the same as the damper shown in FIGS. 1–7 except that the connecting portion 12*a* is molded in an arced shape, rather than being bent upon installation.

The process for installing the damper in a conventional racquet, with a throat bridge, is generally the same as described in connection with FIGS. 3–7. In a conventional racquet, there will be no gap, in a direction perpendicular to the string bed, between adjacent main strings. The main strings will thus all lie generally in the same plane. As a result, when installing the damper on a conventional racquet, instead of passing the end member 10*a* between the gap between the forward lying and rearwardly lying main strings 22, the end member 10*a* and connecting portion 12 are woven into the main strings, in the manner shown and described in U.S. Pat. No. 5,211,397, the relevant portions of which are incorporated herein by reference. Once the connecting portion 12 has been woven into the main strings, the end members 10, 10*a* are inserted between two pairs of intersecting main and cross strings in exactly the same manner as shown in FIGS. 6 and 7.

Figure 9:
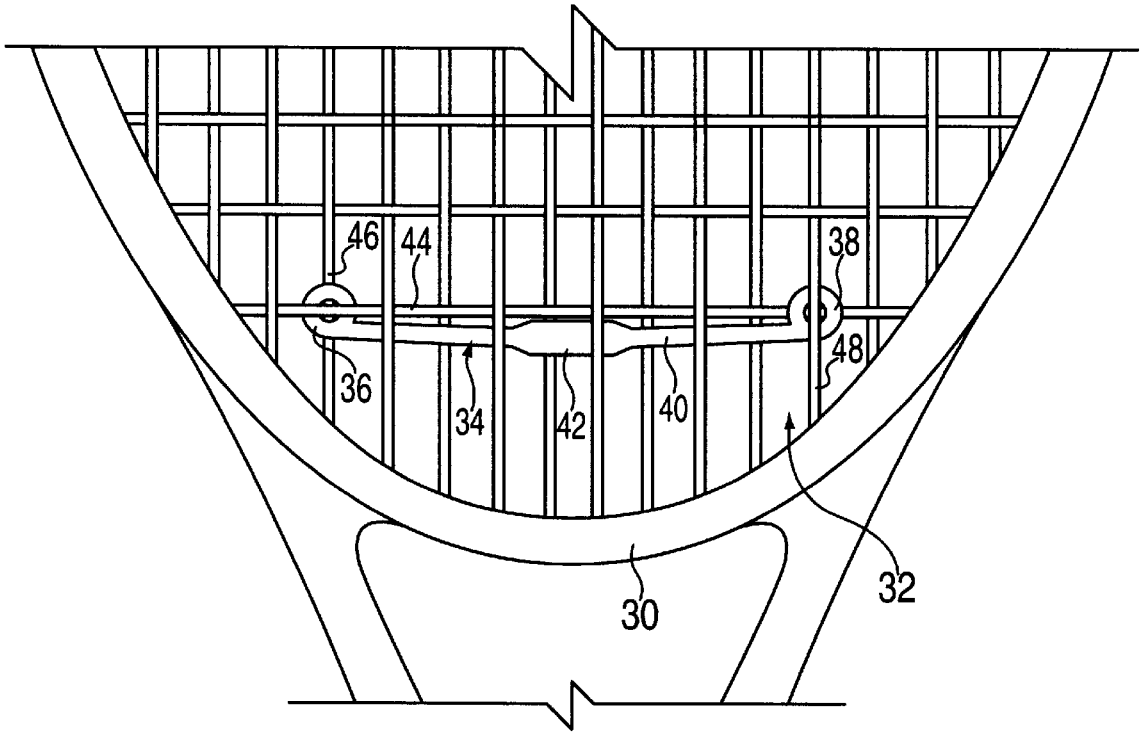
FIG. 9 is a plan view of a portion of a conventional, open throat tennis racquet with a third embodiment of a damper in accordance with the invention.

FIG. 9 shows a portion of a conventional tennis racquet head including an arcuate throat bridge 30 which spans the throat region of the frame and completes the stringing area 32. A third embodiment of a damper 34 includes a pair of end members 36, 38 connected by a connecting web 40. The connecting web 40 includes a middle portion 42 of increased width and, optionally, increased thickness. The end members 36, 38 are generally the same as the end members 10, 10*a* in the damper disclosed in connection with FIGS. 1–4, except that end members 36, 38 are horizontally offset from the axis of the connecting member 40, whereas the end members 10, 10*a* are axially centered relative to the connecting portion 12. As shown in FIG. 9, by axially offsetting the holes of the end members 36, 38, when the end members 36, 38 are secured between the lowermost cross string 44 and intersecting main strings 46, 48, respectively, the connecting web 40 will be offset from the cross string 44.

Figure 10:
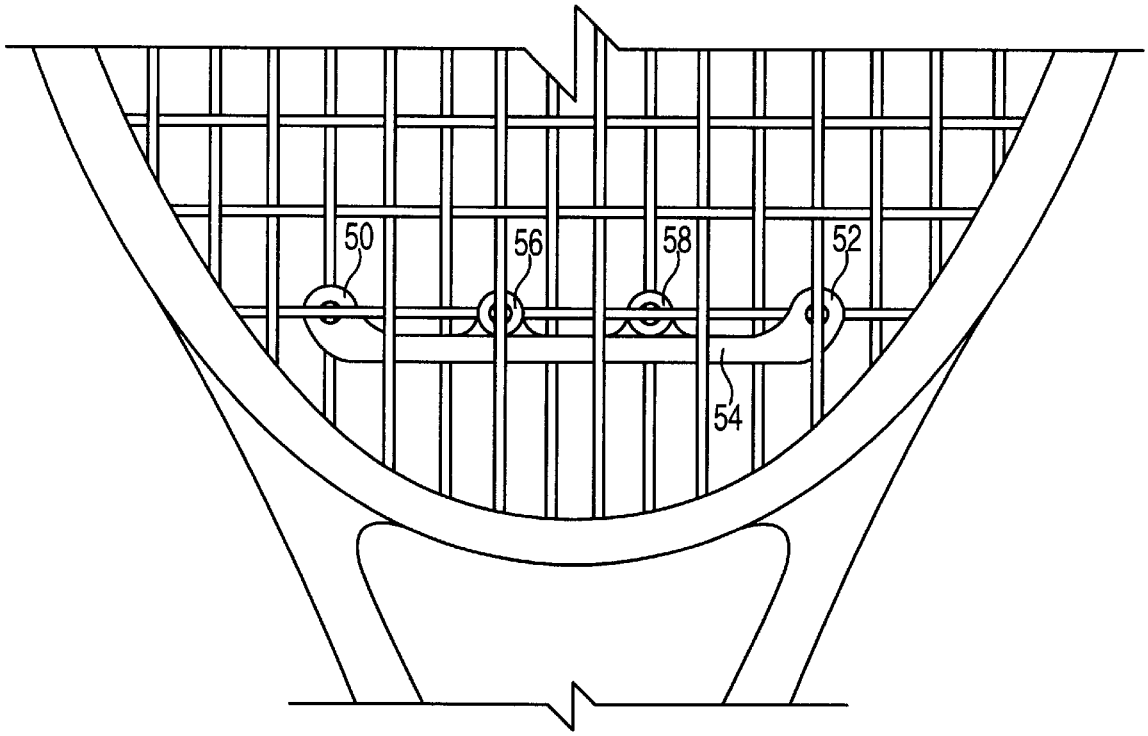
FIG. 10 is a plan view of a portion of a conventional, open throat tennis racquet with a fourth embodiment of a damper in accordance with the invention.

FIG. 10 shows another embodiment of a damper in which, similar to FIG. 9, the end members 50, 52 are offset from the axis of the connecting web 54. In the damper shown in FIG. 10, two additional string securing members 56, 58 extend from the connecting member 54 in the same direction as end members 50, 52. Each string securing member 56, 58 includes a hole so that it may be captured between a pair of intersecting main and cross strings.

Figure 11:
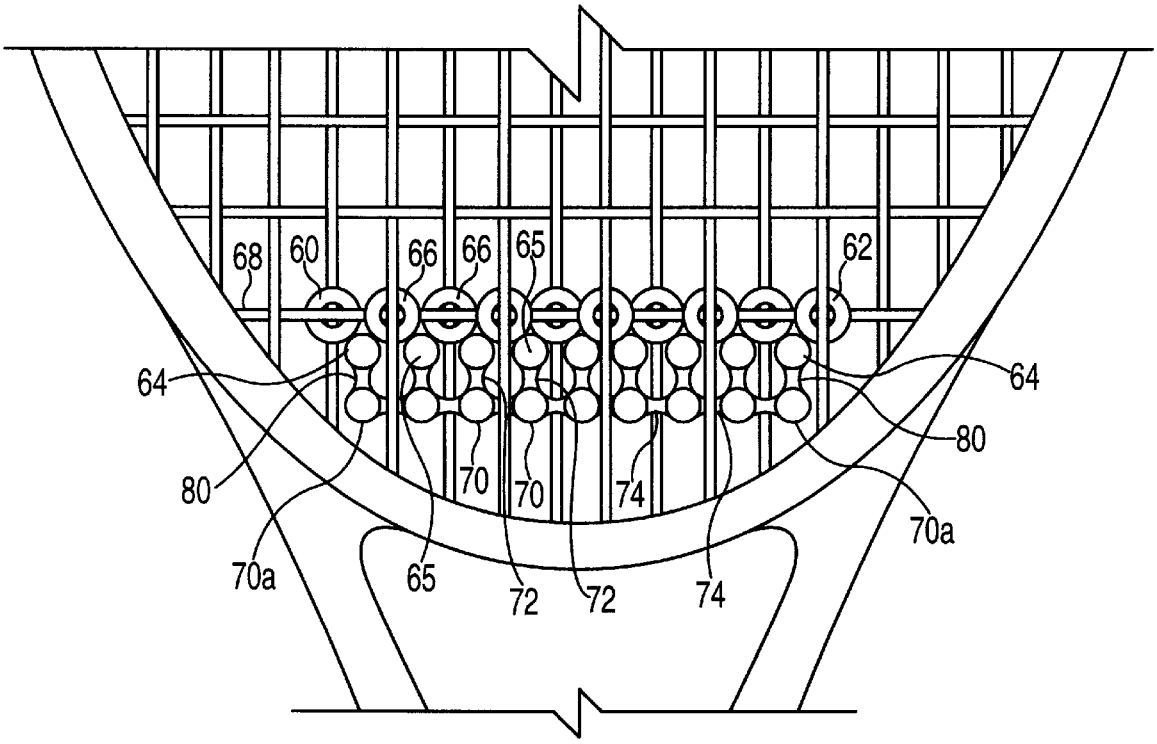
FIG. 11 is a plan view of a portion of a conventional, open throat tennis racquet with a fifth embodiment of a damper in accordance with the invention.

The damper shown in FIG. 11 includes a pair of end members 60, 62, which are linked by a connecting member formed by a series of weight elements 70 connected by flexible web portions 74. The end weight elements 70*a* are coupled to the end members 60, 62 through a thin, flexible projecting portion 80 and a connector element 64 so that the weight elements 70, 70*a* and web portions 74 are axially offset from the centerline running through the two end members 60, 62. As shown, the connector elements 64 engage the end members 60, 62 at a position, relative to the axis of the lowest cross string 68, so that the elements 64 are spaced between main strings. Thus as shown, the connector element 64 secures the end member 60 at approximately the 4:30 position (in a reference frame in which the 12:00 position lies along the main string axis, towards the tip of the racquet), whereas the other connector element secures the end member 62 at approximately the 7:30 position. Successive weight elements 70 are axially spaced by the web portions 74 so as to lie between successive pairs of main strings.

In addition to the connector member formed of weight elements 70, 70*a* and 74 and elements 64 and 80, a projecting portion 72 extends from each weight member 70, perpendicular to the axis of cross string 68. A connector element 65 is formed on the end of each projecting portion 72 and, in turn, a string securing member 66, each having a hole similar to the end string securing members 60, 62, is attached to adjacent pairs of connector elements 64 and/or 65. As shown, the connector elements 65 engage adjacent string securing members 66 at approximately the 4:30 and 7:30 positions. Because the connector elements 64, 65 are spaced between pairs of adjacent main strings, the string securing members 66 will lie at the points of intersection of the main strings and cross string 68 as shown. Each connector element 64 engages a pair of string securing members 60, 62, 66 at a point which is offset from the cross string 68 (which coincides with the centerline running through the end members 60, 62 and string securing members 66). Preferably, the connecting elements 64 are located to the side of the string 68. Because each string securing member 66 is cantilevered to a pair of connecting elements 64, 65 it is flexible, in a direction perpendicular to the string bed, to be located alternately above and below the cross string 68 at successive main string intersection points.

With the damper shown in FIG. 11, the mass of the cantilevered weight elements 70, 70*a* can be adjusted as desired to vibrate at a predetermined frequency, and can be tuned relative to the racquet frame vibration frequency so that the damper will effectively dampen both string vibration and frame vibration.

Figure 12:
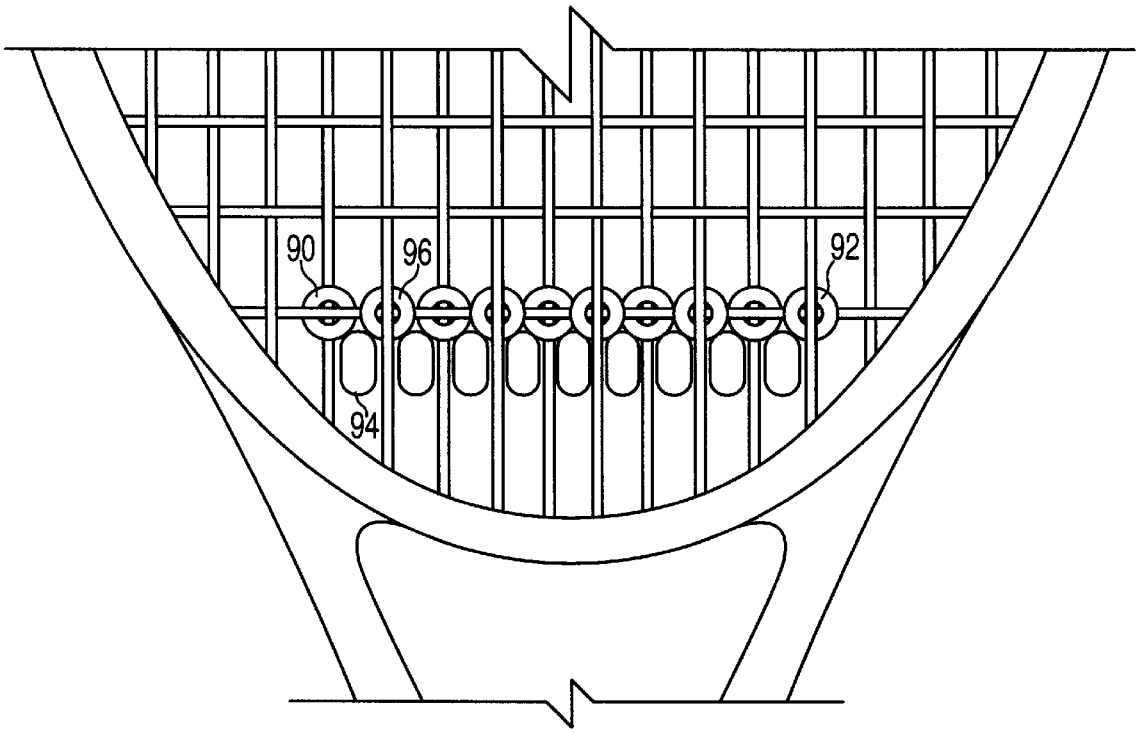
FIG. 12 is a plan view of a portion of a conventional, open throat tennis racquet with a sixth embodiment of a damper in accordance with the invention.

FIG. 12 shows another embodiment of a damper which includes a pair of end string engagement members 90, 92 and a connecting portion formed of alternating weight elements 94 and string engagement members 96. The weight elements 94 are cantilevered off of adjacent pairs of string engagement members 90, 92, 96 so as to extend transverse to the axis of the lowermost cross string. As in the case of FIG. 11, the mass of the weight elements 94 can be selected to tune the damper relative to the racquet frequency to dampen frame vibrations as well as string vibrations.

Figure 13:
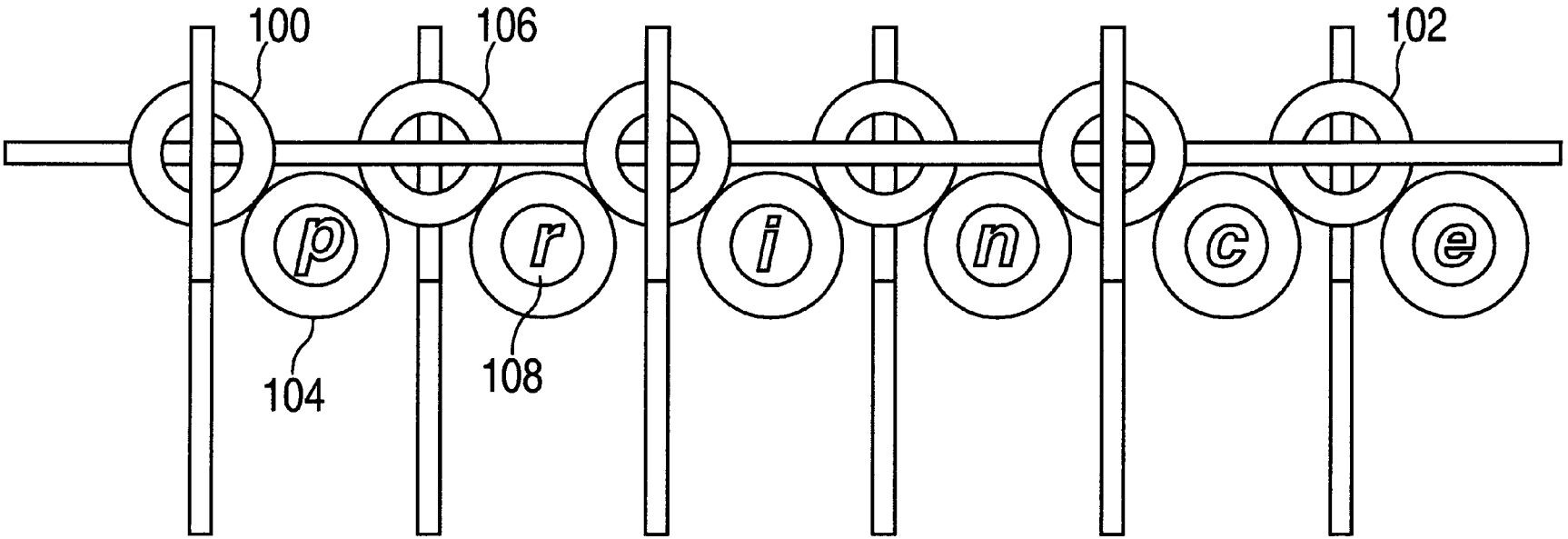
FIG. 13 is a plan view, on an enlarged scale, of a portion of a string bed containing a seventh embodiment of a damper according to the invention.

FIG. 13 shows another embodiment of a damper including a pair of donut shaped end string engagement members 100, 102 connected by a series of alternating connector elements 104 and donut shaped string engagement members 106. The connector elements 104 engage adjacent pairs of string engagement members 100, 102, 106 at approximately the 4:30 and 7:30 positions so that the connector elements 104 are located to the side of the lowest cross string. As shown, the connector elements 104 can include a surface 108 bearing a written indicia, such as the name of the damper manufacturer or a trademark.

The foregoing represents preferred embodiments of the invention. Variations and modifications will be apparent to persons skilled in the art, without departing from the inventive concepts disclosed herein. For example, the exact shape of the end members 10, 10*a* may be varied, provided that a hole of appropriate size is provided to secure the end member between intersecting main and cross strings. Also, the damper can be installed on other parts of the racquet, as shown in U.S. Pat. No. 5,211,397. In addition, while exemplary embodiments show the damper being interwoven with a number of strings, if desired the damper can extend between two adjacent strings. For example, if it is desired to damp only the two center main strings, the end members 10, 10*a* would be connected by a very short connecting portion so that one end member is secured between one center main string and an intersecting cross string, and the other end member is secured between the adjacent center main string and the same cross string. All such modifications and variations are intended to be within the skill of the art, as defined in the following claims.

What is claimed is:

1. In combination a string vibration damper and a sports racquet;

wherein said sports racquet has an interwoven tensioned string bed, including a first pair of crossing strings which touch one another at a first contact point, and a second pair of crossing strings which touch one another at a second contact point, and wherein said damper is made of a soft, elastomeric material and comprises a first end member having a first hole therethrough, a second end member having a second hole therethrough, and a connecting portion connecting said first and second end members, wherein each said hole has a bore axis and a hole diameter, wherein said hole diameter is in the range of 3 mm and 10 mm, wherein each said end member has a maximal cross-sectional height "h," in a direction parallel to said axis, in the range of 1 mm and 6 mm, and wherein said damper is positioned relative to the string bed such that said first contact point lies within said first hole and said second contact point lies within said second hole such that the crossing strings remain touching at said contact points, whereby said end members are secured firmly in place on the string bed.

2. The combination according to claim 1, wherein said hole diameter is in the range of 4 mm and 6 mm and said height is in the range of 2 mm and 4 mm.

3. The combination according to claim 2, wherein said connecting portion has a length of at least 50 mm.

4. The combination according to claim 3, wherein said connecting portion has a length of at least 100 mm.

5. The combination according to claim 4, wherein said end members and said connecting portion have a maximal cross-sectional width "w," and wherein the maximal cross-sectional width of said connecting portion is less than the maximal cross-sectional width of said end members.

6. The combination according to claim 5, wherein said connecting portion has end regions adjacent said end members and a middle portion located therebetween, and wherein said end regions have a cross-sectional width which is less than the cross-sectional width in said middle portion.

7. The combination according to claim 6, wherein said end portions have a maximal cross-sectional width between 6 and 15 mm.

8. The combination according to claim 1, wherein said connecting portion is in the form of a thin, flat web.

9. The combination according to claim 1, wherein said string bed includes a first string, a portion of which extends between said first and second contact points, and a plurality of second strings which extend at least generally perpendicular to said first string and which intersect said first string between said first and second string contact points, and wherein said connecting portion is inter-woven with said second strings.

10. The combination according to claim 9, wherein said string bed includes at least eight of said second strings.

11. The combination according to claim 1, wherein said ends are contorted by portions of the strings adjacent to said first and second contact points.

12. A method of damping string vibrations in a sports racquet having an interwoven, tensioned string bed including at least two pairs of crossing strings, comprising the steps of:

providing a string vibration damper made of a soft, elastomeric material and having a pair of end members connected by a connecting portion, wherein each said end member has a hole therethrough, wherein said hole has a bore axis and a hole diameter, wherein said hole diameter is in the range of 3 mm and 10 mm, and wherein each said end member has a maximal cross-sectional height "h", in a direction parallel to said axis, in the range of 1 mm and 6 mm positioning one of said end members between a first pair of crossing strings so that its hole is coincident with the intersection of the crossing strings, such that said strings remain touching and the tension of the crossing strings contorts said one end member so that it is secured firmly in place; and positioning the other of said end members between a second pair of crossing strings so that its hole is coincident with the intersection of the crossing strings, such that said strings remain touching and the tension of the crossing strings contorts said other end member so that it too is secured firmly in place.

13. A method according to claim 12, wherein said hole diameter is in the range of 4 mm and 6 mm and said height is in the range of 2 mm and 4 mm.

14. A method according to claim 13, wherein said connecting portion has a length of at least 50 mm.

15. A method according to claim 14, wherein said connecting portion has a length of at least 100 mm.

16. A method according to claim 15, wherein said end members and said connecting portion have a maximal cross-sectional width "w", and wherein the maximal cross-sectional width of said connecting portion is less than the maximal cross-sectional width of said end members.

17. A method according to claim 16, wherein said connecting portion has end regions adjacent said end members and a middle portion located therebetween, and wherein said end regions have a cross-sectional width which is less than the cross-sectional width in said middle portion.

18. A method according to claim 17, wherein said end portions have a maximal cross-sectional width between 6 mm and 15 mm.

19. A method according to claim 12, wherein said connecting portion is in the form of a thin, flat web.

* * * * *